US011655528B2

(12) United States Patent
Nymann

(10) Patent No.: US 11,655,528 B2
(45) Date of Patent: May 23, 2023

(54) HIGH STRENGTH HOT-ROLLED STEEL AND METHOD FOR MANUFACTURING HIGH STRENGTH HOT-ROLLED STEEL

(71) Applicant: SSAB TECHNOLOGY AB, Stockholm (SE)

(72) Inventor: Erik Nymann, Borlänge (SE)

(73) Assignee: SSAB TECHNOLOGY AB, Stockholm (SE)

( * ) Notice: Subject to any disclaimer, the term of this patent is extended or adjusted under 35 U.S.C. 154(b) by 0 days.

(21) Appl. No.: 16/767,211

(22) PCT Filed: Nov. 27, 2018

(86) PCT No.: PCT/EP2018/082620
§ 371 (c)(1),
(2) Date: May 27, 2020

(87) PCT Pub. No.: WO2019/110359
PCT Pub. Date: Jun. 13, 2019

(65) Prior Publication Data

US 2020/0308679 A1 Oct. 1, 2020

(30) Foreign Application Priority Data

Dec. 4, 2017 (EP) ..... 17205153

(51) Int. Cl.

| | |
|---|---|
| ***C22C 38/42*** | (2006.01) |
| ***C22C 38/58*** | (2006.01) |
| ***C21D 8/02*** | (2006.01) |
| ***C21D 9/46*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/58* (2013.01); *C21D 8/0226* (2013.01); *C21D 9/46* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/002* (2013.01); *C21D 2211/008* (2013.01)

(58) Field of Classification Search
CPC ..... C21D 9/46; C21D 2211/002
See application file for complete search history.

(56) References Cited

U.S. PATENT DOCUMENTS

| | | | | |
|---|---|---|---|---|
| 6,364,968 | B1 | 4/2002 | Yasuhara et al. | |
| 8,038,809 | B2 | 10/2011 | Satou | |
| 10,000,829 | B2 | 6/2018 | Toda | |
| 10,913,988 | B2 | 2/2021 | Shuto et al. | |
| 2009/0050243 | A1* | 2/2009 | Satou | C22C 38/04 148/602 |
| 2016/0333440 | A1* | 11/2016 | Liimatainen | C22C 38/12 |
| 2018/0237874 | A1 | 8/2018 | Yamazaki et al. | |

FOREIGN PATENT DOCUMENTS

| | | | | |
|---|---|---|---|---|
| CN | 1978695 | A | 6/2007 | |
| CN | 105420632 | A | 3/2016 | |
| CN | 106119702 | A | 11/2016 | |
| EP | 1865083 | A1 | 12/2007 | |
| EP | 2436797 | A1 | 4/2012 | |
| EP | 2617852 | A1 | 7/2013 | |
| JP | 2000109951 | | 4/2000 | |
| JP | 2005002441 | | 1/2005 | |
| JP | 2006152361 | | 6/2006 | |
| JP | 2016050335 | | 4/2016 | |
| WO | WO 2006/103991 | | 10/2006 | |
| WO | WO 2014/171427 | | 10/2014 | |
| WO | WO-2015110585 | A1 * | 7/2015 | C21D 8/0205 |
| WO | WO 2016/133222 | | 8/2016 | |
| WO | WO 2017/017933 | | 2/2017 | |

OTHER PUBLICATIONS

International Search Report and Written Opinion dated Jan. 10, 2019 by the International Searching Authority for International Application No. PCT/EP2018/082620, filed on Nov. 27, 2018 and published as WO 2019/110359 on Jun. 13, 2019 (Applicant-SSAB Technology AB)(10 Pages).

* cited by examiner

*Primary Examiner* — Jophy S. Koshy
(74) *Attorney, Agent, or Firm* — Ballard Spahr LLP

(57) ABSTRACT

Described is a hot-rolled steel having a tensile strength of at least 950 MPa and a microstructure that includes bainite at an area ratio of 70% or more; the balance being: martensite at an area ratio of 30% or less, and optionally ferrite at an area ratio of 20% or less. The hot-rolled steel has a chemical composition containing (in mass-%): C: 0.07-0.10, Si: 0.01-0.25, Mn: 1.5-2.0, Cr: 0.5-1.0, Ni: 0.1-0.5, Cu: 0.1-0.3, Mo: 0.01-0.2, Al: 0.01-0.05, Nb: 0.015-0.04, V: 0-0.1, i.e. optionally up to 0.1 mass-% Vanadium, Ti: 0-0.1, whereby the balance is Fe and unavoidable impurities.

14 Claims, 1 Drawing Sheet

HIGH STRENGTH HOT-ROLLED STEEL AND METHOD FOR MANUFACTURING HIGH STRENGTH HOT-ROLLED STEEL

CROSS-REFERENCE TO RELATED APPLICATIONS

This application is a U.S. National Phase Application of International Application No. PCT/EP2018/082620, filed Nov. 27, 2018, which claims the benefit of European Application No. 17205153.4, filed Dec. 4, 2017, each of which are hereby incorporated by reference in their entirety.

TECHNICAL FIELD

The present invention concerns high strength hot-rolled steel, i.e. hot-rolled steel having a tensile strength of at least 950 MPa, which is suitable for use in the automotive or vehicle construction industry. The present invention also concerns a method for the manufacture of such high-strength hot-rolled steel.

The hot-rolled steel described herein has been developed by the Applicant as part of a cooperation project with Toyota and Gestamp.

BACKGROUND OF THE INVENTION

The demand for high-strength steel sheets having a tensile strength of at least 590 MPa, and preferably of at least 780 MPa, with improved fatigue and formability has been increasing over the last few years. High strength steel sheets have, for example, been used to manufacture chassis parts, bumper components, suspension parts and impact beams for vehicles in order to reduce the weight of the vehicle body, and thereby reduce fuel consumption, and to suppress deformation of passenger compartments during collisions and thereby improve safety. The high strength of the steel sheets in conjunction with their improved fatigue and formability make the steel sheets especially suitable for fatigue-subjected components where the high strength of the steel enables thinner gauges to be used.

U.S. Pat. No. 6,364,968 discloses a high-strength hot-rolled steel sheet having a tensile strength of at least 780 MPa and a thickness of not more than 3.5 mm which has excellent stretch flangeability and high uniformity in both shape and mechanical properties. A steel slab having a chemical composition containing C: about 0.05-0.30 wt %, Si: about 0.03-1.0 wt %, Mn: about 1.5-3.5 wt %, P not more than about 0.02 wt % S: not more than about 0.005 wt %, Al: not more than about 0.150 wt %, N: not more than about 0.0200 wt 30%, one or both of Nb: about 0.003-0.20 wt % and Ti: about 0.005-0.20 wt %, and the balance consisting of Fe and inevitable impurities, is heated to a temperature of not more than 1200° C. The steel slab is hot-rolled at a finish rolling end temperature of not less than 800° C., preferably at a finish rolling start temperature of 950-1050° C. The cooling of the hot-rolled sheet is started within two seconds after the end of the hot-rolling, and the steel sheet is then continuously cooled down to a coiling temperature of 300-550° C. at a cooling rate of 20-150° C./sec. The steel sheet has a microstructure containing fine bainite grains with a mean grain size of not more than about 3.0 μm at an area percentage of not less than about 90%.

European patent no. 2,436,797 describes a high-strength steel sheet having a tensile strength of at least 590 MPa excellent fatigue properties, elongation and collision properties, comprising: in terms of percent by mass, 0.03 to 0.10% of C; 0.01 to 1.5% of Si; 1.0 to 2.5% of Mn; 0.1% or less of P; 0.02% or less of S; 0.01 to 1.2% of Al; 0.06 to 0.15% of Ti; 0.01% or less of N; and optionally one or more selected from the group consisting of 0.005 to 0.1% of Nb; 0.005 to 0.2% of Mo; 0.005 to 0.2% of V; 0.0005 to 0.005% of Ca; 0.0005 to 0.005% of Mg; 0.0005 to 0.005% of B; 0.005 to 1% of Cr; 0.005 to 1% of Cu; and 0.005 to 1% Ni; with the balance being iron and inevitable impurities. The steel sheet has a tensile strength in the range of 590 MPa or more, and a ratio of the yield strength to the tensile strength in the range of 0.80 or more. The microstructure of the steel sheet comprises bainite at an area ratio of 40% or more; the balance being either one or both of ferrite and martensite. The density of Ti(C,N) precipitates having sizes of 10 nm or smaller is in the range of $10^{10}$ precipitates/$mm^3$ or more, and a ratio (Hvs/Hvc) of a hardness (Hvs) at a depth of 20 μm from a surface to a hardness (Hvc) at a center of a sheet thickness is in the range of 0.85 or more.

EP 2,436,797 discloses that "In practice, the Mn content [of the hot-rolled steel sheet] is preferably in a range of 1.0 to 1.8% with regard to the steel sheet having a tensile strength of 590 to 700 MPa, and the Mn content is preferably in a range of 1.6 to 2.2% with regard to the steel sheet having a tensile strength of 700 MPa to 900 MPa, and the Mn content is preferably in a range of 2.0 to 2.5% with regard to the steel sheet having a tensile strength of 900 MPa or more. There is a suitable Mn amount range depending on the tensile strength, and an excessive addition of Mn causes deterioration of workability due to Mn segregation. Therefore, it is preferable that the Mn content be adjusted in accordance with the tensile strength as described above."

EP 2,436,797 thereby teaches the skilled person that in order to achieve a tensile strength of 900 MPa or more, the steel must contain 2.0 to 2.5 mass-% Mn.

SUMMARY OF THE INVENTION

An object of the invention is to provide a hot-rolled steel having a tensile strength of at least 950 MPa and good fatigue and formability (processability) properties.

At least one of these objects is achieved by hot-rolled steel that has a microstructure comprising bainite at an area ratio of 70% or more; the balance being martensite at an area ratio of 30% or less, and optionally ferrite at an area ratio of 20% or less, and a chemical composition containing (in mass-%)

| | |
|---|---|
| C | 0.07-0.10 |
| Si | 0.01-0.25 |
| Mn | 1.5-2.0, or 1.7-2.0 |
| Cr | 0.5-1.0 |
| Ni | 0.1-0.5, or 0.1 to 0.3 |
| Cu | 0.1-0.3 |
| Mo | 0.01-0.2 |
| Al | 0.01-0.05 |
| Nb | 0.015-0.04 |
| V | 0-0.1 (optional) |
| Ti | 0-0.1, or 0.03-0.1 |
| balance Fe and unavoidable impurities. | |

Unavoidable impurities may be a maximum of 74 ppm N or max. 54 ppm N, and/or max. max. 44 ppm S and/or max. 0.025 mass-% P, max. 0.010 mass-% Pb, max. 0.010 mass-25% Sb, max. 0.005 mass-% Bi, max. 0.020 mass-% As, max. 0.030 mass-% Co.

The hot-rolled steel comprises both Niobium and (a relatively high amount of) Titanium as essential elements and a maximum of 2.0 mass-% Manganese. According to an embodiment the hot-rolled steel comprises less than 2.0 mass-% Manganese. The hot-rolled steel does not comprise intentionally-added Boron.

A complex phase microstructure comprising bainite and martensite gives the hot-rolled steel a high tensile strength, i.e. a tensile strength of at least 950 MPa, or at least 1000 MPa, or at least 1050 MPa or at least 1100 MPa.

According to an embodiment a majority of the bainite in the microstructure of the hot-rolled steel is upper bainite, i.e. at least 51% of the bainite in the microstructure of the hot-rolled steel is upper bainite. The average bainite grain size is not greater than 5 μm. According to an embodiment the microstructure of the hot-rolled steel comprises islands of martensite in a bainite matrix.

According to an embodiment the microstructure comprises martensite at an area ratio of at least 10%, or more than 10%, such as martensite at an area ratio of 10-20%. The maximum area ratio of bainite in the microstructure is less than 90%, 85% or less, or 80% or less.

According to an embodiment the hot-rolled steel has a yield strength of 720-950 MPa, or at least 780-950 MPa.

According to an embodiment the hot-rolled steel has an elongation of at least 8%, or at least 10%.

According to an embodiment the hot-rolled steel has a hole expansion ratio of at least 25%, or at least 30% (measured in accordance with the ISO 16630:2009 standard), which is high for hot-rolled steel having a tensile strength of at least 950 MPa.

According to an embodiment the hot-rolled steel has a thickness of 4 mm or less, or 3.5 mm or less, or 3.0 mm or less, or 2.5 mm or less, or 2 mm or less.

The present invention also concerns a method for manufacturing hot-rolled steel according to any of the embodiments of the invention. The manufactured hot-rolled steel has a tensile strength of at least 950 MPa and a microstructure comprising bainite at an area ratio of 70% or more; the balance being: martensite at an area ratio of 30% or less, and optionally ferrite at an area ratio of 20% or less, and a chemical composition containing (in mass-%)

| | |
|---|---|
| C | 0.07-0.10 |
| Si | 0.01-0.25 |
| Mn | 1.5-2.0 |
| Cr | 0.5-1.0 |
| Ni | 0.1-0.5 |
| Cu | 0.1-0.3 |
| Mo | 0.01-0.2 |
| Al | 0.01-0.05 |
| Nb | 0.015-0.04 |
| V | 0-0.1 (optional) |
| Ti | 0-0.1, or 0.03-0.1 |
| balance Fe and unavoidable impurities. | |

The method comprises the following steps:

heating steel having the chemical composition described above to a temperature of at least 1250° C., hot-rolling the steel at a finishing rolling temperature of 850-930° C., i.e. a temperature equal to or greater than the $A_3$ point, quenching the steel to a coiling temperature of 450-575° C., or 475-575° C., coiling the steel at the coiling temperature, cooling the steel, and skin pass rolling.

The steel must be heated to a temperature of at least 1250° C. prior to hot-rolling in order to ensure that the relatively high amount of Titanium is re-dissolved. The skin pass rolling (which is normally carried out to improve the flatness of materials) is used to improve the tensile strength and the surface quality of the steel and also reduces the surface roughness of the steel, which improves the fatigue properties of the steel and consequently the performance of a component comprising the steel.

According to an embodiment the skin pass rolling step comprises skin pass rolling at a reduction of 0.5-2% or 1-2%. By applying a small reduction during the skin pass rolling, the tensile strength of the material improves while the initial microstructure is maintained. The skin pass rolling step is essential for obtaining high-strength steel having a tensile strength of at least 950 MPa. Due to the skin pass rolling step, a Manganese content of 1.5-2.0 mass-% is sufficient.

According to an embodiment the quenching step comprises quenching the steel at a rate of at least 60° C./s, or at least 100° C./s or at least 150° C./s. The quenching may be carried out in a quenching medium such as water or oil.

According to an embodiment, the cooling step comprises cooling the steel at a cooling rate of 10° C./s or less, to room temperature for example. The cooling step may extend over a period of one or more days. Such slow cooling promotes the formation of the desired microstructure. The transformation is complete after the cooling line so the amount of transformation taking place after the coiling step is limited. Some bainite and martensite formation might take place during the coiling step, but in a limited way.

The present invention further concerns the use of hot-rolled steel according to any of the embodiments of the invention and manufactured according to a method according to any of the embodiments of the invention in the automotive or vehicle construction industry. The hot-rolled steel may namely be used for any component of a vehicle, such as a motor vehicle, i.e. any self-propelled road vehicle or off-road vehicle, such as a car, truck or motorbike, or heavy-duty vehicle for executing construction tasks or earthwork operations, such as an excavator, or for any component of a vehicle that operates on rails, such as a train or tram, or any vehicle used for the transportation of at least one person or goods, or a driverless vehicle, or an aircraft or drone. The hot-rolled steel may however be used for any other suitable application, such as for structural components in the construction industry.

BRIEF DESCRIPTION OF THE DRAWINGS

The present invention will hereinafter be further explained by means of non-limiting examples with reference to the appended figures where.

DETAILED DESCRIPTION OF EMBODIMENTS

Figure 1:
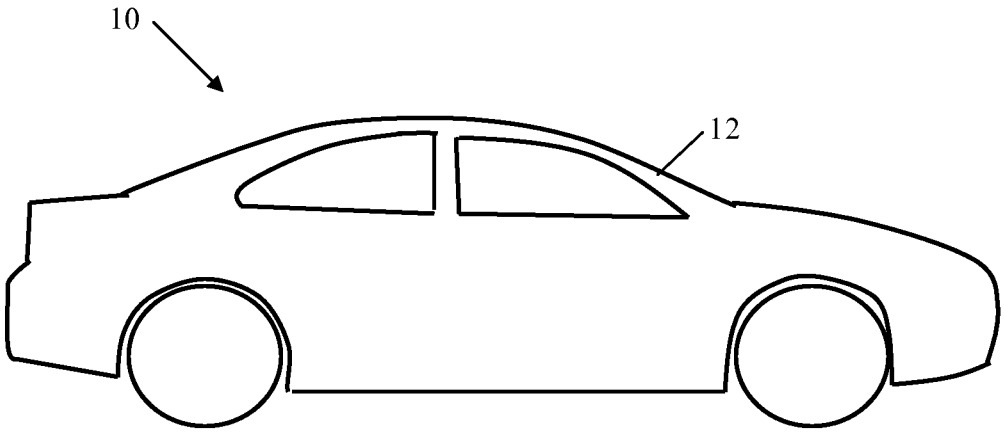
FIG. 1 shows a vehicle that includes at least one component comprising hot-rolled steel according to any of the embodiments of the invention.

FIG. 1 shows a vehicle 10 that includes at least one component comprising hot-rolled steel according to any of the embodiments of the invention. The vehicle 10 may for example comprise a chassis part, such as an A-pillar 12, that comprises at least one hot-rolled steel sheet having a tensile strength of at least 950 MPa and a thickness of 2-4 mm. The hot-rolled steel has a microstructure comprising bainite at an area ratio of 70% or more; the balance being: martensite at an area ratio of 30% or less, and optionally ferrite at an area ratio of 20% or less, and a chemical composition containing (in mass-%): C: 0.07-0.10, Si: 0.01-0.25, Mn: 1.5-2.0, Cr: 0.5-1.0, Ni: 0.1-0.5, Cu: 0.1-0.3, Mo: 0.01-0.2, Al: 0.01-0.05, Nb: 0.015-0.04, V: 0-0.1, i.e. optionally up to 0.1 mass-% Vanadium, Ti: 0-0.1, whereby the balance is Fe and unavoidable impurities.

For example, the chemical composition of the hot-rolled steel comprises the following in mass-%:

| | |
|---|---|
| C | 0.09 |
| Si | 0.18 |
| Mn | 1.80 |
| Cr | 0.75 |
| Ni | 0.15 |
| Cu | 0.15 |
| Mo | 0.10 |
| Al | 0.035 |
| Nb | 0.030 |
| V | 0 |
| Ti | 0.045 |
| balance Fe and unavoidable impurities. | |

The hot-rolled steel does not contain any Boron.

The C content is set to be in a range of 0.07 to 0.10 mass-%. In the case where the C content is less than 0.07%, the target tensile strength cannot be achieved. If the C content exceeds 0.10%, weldability, elongation, and consequently the formability of the steel are deteriorated.

Si is a solid-solution strengthening element and is effective in increasing the strength; and therefore, as the Si content is increased, the balance between tensile strength and elongation is improved.

The Mn content is set to be in a range of 1.5 to 2.0 mass-% or 1.7 to 2.0 mass-%. Mn is an effective element in enhancing solid-solution strengthening and hardenability. An excessive addition of Mn causes deterioration of workability due to Mn segregation.

Cr is effective in enhancing hardenability. As the Cr content is increased, the tensile strength of the steel sheet is increased. However, if the Cr content is too large, Cr-based alloy carbides such as $Cr_{23}C_6$ are precipitated, and when these carbides are preferentially precipitated in the grain boundaries, press formability is deteriorated. Therefore, the upper limit of the Cr content is set to be 1.0 mass-%.

Ni enhances hardenability of the steel, contributes to the improvement of toughness and prevents hot brittleness. Since Ni is a relatively expensive alloying element, the upper limit of the Ni content is set to be 0.5 mass-%, or 0.3 mass-%.

Cu increases the strength of the steel due to precipitation thereof. Alloying elements such as Ti are bonded to C or N and form alloy carbides; however, Cu is precipitated solely and strengthens the steel material. Steel containing a large amount of Cu may become brittle during hot-rolling. The upper limit of the Cu content is therefore set to be 0.3 mass-%.

Mo is a precipitation strengthening element. However, if the Mo content exceeds 0.2 mass-%, the effect of improving precipitation strengthening is small, and in addition, elongation is deteriorated.

The Al content is set to be in a range of 0.01 to 0.05 mass-%. Al is added as a deoxidizing element so that the amount of dissolved oxygen in a molten steel can be reduced. If the Al content is 0.01 mass-% or more, it is possible to prevent Ti, Nb, Mo, and V from forming alloy oxides with dissolved oxygen.

Nb is a precipitation strengthening element. Nb also delays the rate of recrystallization of austenite during hot-rolling. Therefore, in the case where the Nb content is excessive, workability and elongation are adversely affected. The upper limit of the Nb content is therefore set to be 0.1 mass-%. Nb contributes to making grain sizes finer.

V, an optional element in the hot-rolled steel according to the present invention, is a precipitation strengthening element. However, if the V content exceeds 0.1%, the effect of improving the precipitation strengthening is small, and elongation may deteriorate. A maximum of 0.1 mass-% Vanadium may therefore be added.

The Ti content is set to be in a range of 0 to 0.1 mass-%, or 0.03 to 0.1 mass-%. Ti is a precipitation strengthening element. The steel must be heated to a temperature of at least 1250° C. prior to hot-rolling in order to ensure that this relatively high amount of T is re-dissolved.

It is important that Ti is dissolved before hot-rolling to enable fine precipitates to form during the hot-rolling. The Titanium Carbide (TiC) inclusions in the slabs may be coarse which is not beneficial for strengthening. Therefore, the Ti needs to be dissolved to enable it to form finer TiC inclusions during the hot-rolling, which enables more effective precipitation strengthening. Furthermore, Ti helps to hinder or prevent grain coarsening during the heating step.

The microstructure of the hot-rolled steel may from example comprise bainite at an area ratio of 70-80% and martensite at an area ratio of 10-20%, the remainder being ferrite at an area ratio of 20% or less. Alternatively, the microstructure of the hot-rolled steel may comprise only bainite at an area ratio of 70-90% and martensite at an area ratio of 10-30%. The microstructure may comprise islands of martensite in a bainite matrix. The majority of the bainite in the microstructure of the hot-rolled steel is upper bainite.

The hot-rolled steel has a yield strength of 720-950 MPa and/or an elongation of at least 8% and/or a hole expansion ratio of at least 25%.

Figure 2:
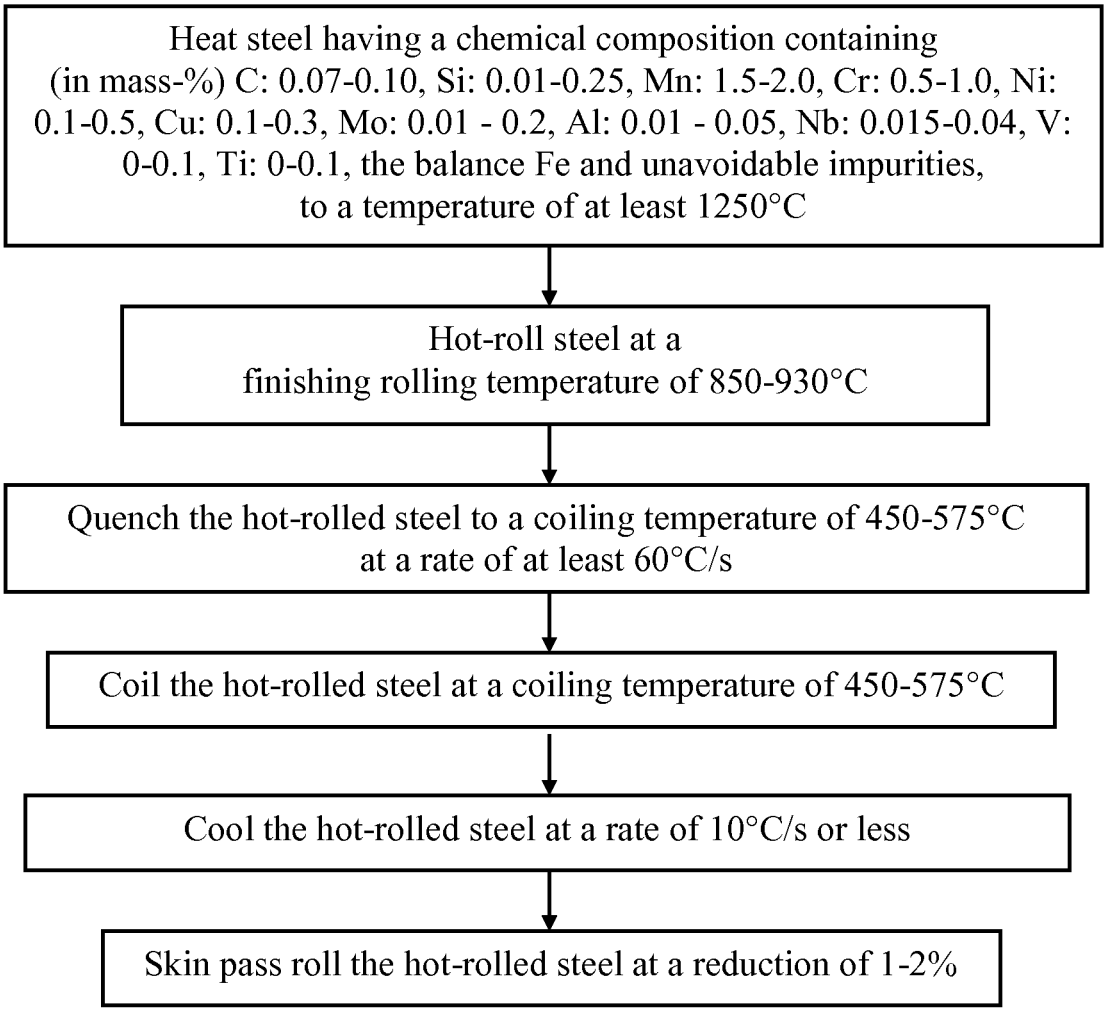
FIG. 2 is a flow chart showing the steps of a method according to an embodiment of the invention.

FIG. 2 is a flow chart showing the steps of a method for manufacturing hot-rolled steel having a tensile strength of at least 950 MPa and a microstructure comprising bainite at an area ratio of 70% or more; the balance being: martensite at an area ratio of 30% or less and optionally ferrite at an area ratio of 20% or less, and a chemical composition containing (in mass-%): C: 0.07-0.10, Si: 0.01-0.25, Mn: 1.5-2.0, Cr: 0.5-1.0, Ni: 0.1-0.5, Cu: 0.1-0.3, Mo: 0.01-0.2, Al: 0.01-0.05, Nb: 0.015-0.04, V: 0-0.1, i.e. optionally up to 0.1 mass-% Vanadium, Ti: 0.05-0.1, whereby the balance is Fe and unavoidable impurities.

The method comprises the following steps which are carried out in the following order: heating steel having the chemical composition to a temperature of at least 1250° C., hot-rolling the steel at a finishing rolling temperature of 850-930° C., quenching the steel in water for example to a coiling temperature of 450-575° C. or 475-575° C. at a rate of at least 60° C./s, coiling the steel at the coiling temperature, cooling the steel, and skin pass rolling at a reduction of 0.5-2%. During coiling, the cooling rate should be 10° C./s or less, which is achieved by maintaining the steel at the coiling temperature. After coiling the steel may be cooled to room temperature at a cooling rate of 10° C./s or less, over a period of three or four days for example, and then skin pass rolled. The skin pass rolling thereby takes place when the steel is at room temperature or within 5-30° C. of the ambient temperature. Alternatively, there may be one or more additional steps between the coiling step and the skin pass rolling step, such as an annealing step or an acid pickling step.

A method according to an embodiment of the invention produces hot-rolled steel having the tensile strength, microstructure, chemical composition and properties described herein. Such a hot-rolled steel is suitable for use in the automotive or vehicle construction industry, which may result in the manufacture of more light-weight and crash-resistant vehicle components.

Example 1

Hot-rolled steel having the following chemical composition in mass-% was manufactured using a method according to an embodiment of the invention: C 0.09, Si 0.18, Mn 1.80, Cr 0.75, Ni 0.15, Cu 0.15, Mo 0.10, Al 0.035, Nb 0.030, V 0, Ti 0.045, B 0, balance Fe and unavoidable impurities.

The method comprised the following steps:

heating steel having said chemical composition to a temperature of 1280° C., hot-rolling said steel at a finishing rolling temperature of 890° C., quenching said steel to a coiling temperature of 525° C. at a cooling rate of 230° C./s, coiling said steel at said coiling temperature of 525° C., cooling said steel to room temperature at a cooling rate of less than 5° C./min, such as 2.5° C./s, whereby a cooling rate of 2.5° C./s may take place on the run-out table of a cooling line, and skin pass rolling at a reduction of 0.5%.

The hot-rolled steel had a yield strength of 836 MPa, a tensile strength of 979 MPa, an elongation of 10% and a hole expansion ratio of 35% which was measured in accordance with the ISO 16630:2009 standard.

Example 2

Hot-rolled steel having the following chemical composition in mass-% was manufactured using a method according to an embodiment of the invention: C 0.088, Si 0.2, Mn 1.78, Cr 0.75, Ni 0.15, Cu 0.15, Mo 0.10, Al 0.038, Nb 0.027, V 0, Ti 0.046, B 0, balance Fe and unavoidable impurities.

The method comprised the following steps:

heating steel having said chemical composition to a temperature of 1283° C., hot-rolling said steel at a finishing rolling temperature of 904° C., quenching said steel to a coiling temperature of 530° C. at a cooling rate of 230° C./s, coiling said steel at said coiling temperature of 530° C., cooling said steel to room temperature at a cooling rate of less than 5° C./min, such as 2.5° C./s, whereby a cooling rate of 2.5° C./s may take place on the run-out table of a cooling line, and skin pass rolling at a reduction of 0.5%.

The hot-rolled steel had a yield strength of 854 MPa, a tensile strength of 992 MPa, an elongation of 11% and a hole expansion ratio of 30% which was measured in accordance with the ISO 16630:2009 standard.

Example 3

Hot-rolled steel having the following chemical composition in mass-% was manufactured using a method according to an embodiment of the invention: C 0.082, Si 0.17, Mn 1.8, Cr 0.75, Ni 0.2, Cu 0.2, Mo 0.10, Al 0.035, Nb 0.028, V 0.048, Ti 0, B 0, balance Fe and unavoidable impurities.

The method comprised the following steps:

heating steel having said chemical composition to a temperature of 1284° C., hot-rolling said steel at a finishing rolling temperature of 878° C., quenching said steel to a coiling temperature of 519° C. at a cooling rate of 230° C./s, coiling said steel at said coiling temperature of 519° C., cooling said steel to room temperature at a cooling rate of less than 5° C./min, such as 2.5° C./s, whereby a cooling rate of 2.5° C./s may take place on the run-out table of a cooling line, and skin pass rolling at a reduction of 0.5%.

The hot-rolled steel had a yield strength of 852 MPa, a tensile strength of 995 MPa, an elongation of 11% and a hole expansion ratio of 30% which was measured in accordance with the ISO 16630:2009 standard.

Further modifications of the invention within the scope of the claims would be apparent to a skilled person.

The invention claimed is:

1. A hot-rolled steel having a tensile strength of at least 950 MPa, characterized by:

a microstructure comprising, bainite at an area ratio of 70% or more wherein a majority of said bainite is upper bainite; the balance being: martensite at an area ratio of 30% or less, and optionally ferrite at an area ratio of 20% or less, and a chemical composition consisting of, in mass %, C: 0.07-0.10, Si: 0.01-0.25, Mn: 1.5-2.0, Cr: 0.5-1.0, Ni: 0.1-0.5, Cu: 0.1-0.3, Mo: 0.01-0.2, Al: 0.01-0.05, Nb: 0.015-0.04, V: 0-0.1, Ti: 0-0.1, and balance being Fe and unavoidable impurities.

2. The hot-rolled steel according to claim 1, wherein said microstructure comprises islands of martensite in a bainite matrix.

3. The hot-rolled steel according to claim 1, wherein said microstructure comprises martensite at an area ratio of at least 10% to 30% or less.

4. The hot-rolled steel according to claim 1, wherein said microstructure comprises bainite at an area ratio from 70% or more to less than 90%.

5. The hot-rolled steel according to claim 1, wherein said hot-rolled steel has a yield strength of 720-950 MPa.

6. The hot-rolled steel according to claim 1, wherein said hot-rolled steel has an elongation of at least 8%.

7. The hot-rolled steel according to claim 1, wherein said hot-rolled steel has a hole expansion ratio of at least 25%.

8. The hot-rolled steel according to claim 1, wherein said hot-rolled steel has a thickness of 4 mm or less.

9. A vehicle comprising the hot-rolled steel of claim 1.

10. The vehicle of claim 9, wherein the vehicle is an automotive vehicle.

11. A method for manufacturing the hot-rolled steel of claim 1, wherein the method comprises:

heating a steel having a chemical composition consisting of, in mass %, C: 0.07-0.10, Si: 0.01-0.25, Mn: 1.5-2.0, Cr: 0.5-1.0, Ni: 0.1-0.5, Cu: 0.1-0.3, Mo: 0.01-0.2, Al: 0.01-0.05, Nb: 0.015-0.04, V: 0-0.1, Ti: 0-0.1, and balance being Fe and unavoidable impurities to a temperature of at least 1250° C., hot-rolling said steel at a finishing rolling temperature of 850-930° C., quenching said steel to a coiling temperature of 450-575° C., coiling said steel at said coiling temperature, cooling said steel, and skin pass rolling said steel.

12. The method according to claim 11, wherein said skin pass rolling step comprises skin pass rolling at a reduction of 0.5-2%.

13. The method according to claim 11, wherein said quenching step comprises quenching said steel at a rate of at least 60° C/s.

14. The method according to claim 11, wherein said cooling step comprises cooling said steel at a cooling rate of 10° C/s or less.

* * * * *